US008950165B2

(12) United States Patent
Feijen

(10) Patent No.: US 8,950,165 B2
(45) Date of Patent: Feb. 10, 2015

(54) METHOD AND AN APPARATUS FOR INSERTING A POSTAL ITEM INTO AN ENVELOPE

(75) Inventor: Fransiscus Hermannus Feijen, Leeuwarden (NL)

(73) Assignee: Neopost Technologies, Bagneux (FR)

( * ) Notice: Subject to any disclaimer, the term of this patent is extended or adjusted under 35 U.S.C. 154(b) by 901 days.

(21) Appl. No.: 12/469,427

(22) Filed: May 20, 2009

(65) Prior Publication Data

US 2009/0288373 A1 Nov. 26, 2009

(30) Foreign Application Priority Data

May 20, 2008 (EP) ..... 08156557

(51) Int. Cl.
*B65B 43/26* (2006.01)

(52) U.S. Cl.
USPC ..... 53/468; 53/460; 53/381.5; 53/381.3

(58) Field of Classification Search
CPC ..... B65B 3/003; B65B 43/123; B65B 43/28; B65B 7/2842; B31B 2221/05; B31B 2221/10; B43M 3/045; B43M 5/042
USPC ..... 53/468, 460, 381.5, 569, 284.3, 381.3, 53/381.7
See application file for complete search history.

(56) References Cited

U.S. PATENT DOCUMENTS

| | | | | | |
|---|---|---|---|---|---|
| 3,974,749 | A * | 8/1976 | Luperti et al. | ..... | 493/465 |
| 3,996,727 | A * | 12/1976 | Irvine et al. | ..... | 53/381.7 |
| 4,205,506 | A * | 6/1980 | Moens et al. | ..... | 53/569 |
| 4,649,691 | A * | 3/1987 | Buckholz | ..... | 53/53 |
| 4,944,137 | A * | 7/1990 | Krasuski et al. | ..... | 53/569 |
| 5,327,701 | A * | 7/1994 | Dronsfield | ..... | 53/284.3 |
| 6,666,000 | B1 * | 12/2003 | Werner | ..... | 53/381.7 |
| 6,973,762 | B2 * | 12/2005 | Miller et al. | ..... | 53/381.6 |
| 7,155,878 | B2 * | 1/2007 | Stemmle et al. | ..... | 53/381.5 |
| 7,401,448 | B2 * | 7/2008 | Sytema et al. | ..... | 53/381.7 |

* cited by examiner

*Primary Examiner* — Sameh H. Tawfik
(74) *Attorney, Agent, or Firm* — Sughrue Mion, PLLC

(57) ABSTRACT

In an apparatus for inserting a postal item into an envelope, the envelope is fed with its flap fold trailing its envelope body and its flap along a flap opener. A free flap opener edge enters between the flap and the envelope body until the flap fold abuts the free flap opener edge. While holding the flap against the flap opener, the flap is pivoted relative to the envelope body about the flap fold to an open position and subsequently the postal item is inserted into the envelope body. An apparatus for carrying such a method is also described.

6 Claims, 6 Drawing Sheets

METHOD AND AN APPARATUS FOR INSERTING A POSTAL ITEM INTO AN ENVELOPE

FIELD AND BACKGROUND OF THE INVENTION

The invention relates to a method and an apparatus for inserting a postal item into an envelope.

In apparatuses for inserting postal items, such as sheets, sets of sheets, cards, booklets, electronic data carriers and other generally flat articles, envelopes are typically transported one by one from an envelope stock to an inserting position, the postal items being inserted each time after an envelope has been brought in the inserting position. To avoid damage to the postal items during insertion of the postal items or during closing of the flap of the envelope, it is important that the envelope is positioned accurately in the inserter position.

Since envelopes in the inserting position are typically held in position by engaging the flap only, because the envelope body must be left free to expand to accommodate to the postal items being inserted, accurately stopping the envelopes generally requires transport members engaging the flap to be stopped in an accurately determined position. This requires complex and therefore costly solutions, in particular if envelopes are to be transported at high speeds to achieve a high processing capacity.

SUMMARY OF THE INVENTION

The invention provides a method for inserting a postal item into an envelope having an envelope body and a flap hinged to the envelope body along a flap fold, including:

feeding the envelope with the flap fold trailing the envelope body and the flap along a flap opener;

entering a free flap opener edge between the flap and the envelope body until the flap fold abuts the free flap opener edge;

holding the flap against the flap opener; and while holding the flap against the flap opener, pivoting the flap relative to the envelope body about the flap fold to an open position and inserting the postal item into the envelope body.

The invention can also be embodied in an apparatus for inserting a postal item into an envelope having an envelope body and a flap hinged to the envelope body along a flap fold, including:

an envelope transport path for transporting an envelope with its envelope body in an orientation parallel to the envelope transport path and with the flap fold trailing the envelope body and the flap;

a flap opener, which, in at least one operating position, has a free flap opener edge in a position relative to the envelope transport path for entering between the flap and the envelope body until the flap fold abuts the free flap opener edge;

a postal item transport path for transporting postal items;

an inserting position downstream of the envelope transport path and the postal item transport path; and a flap support member for holding the flap of the envelope against the flap opener, the flap opener and the flap support member being movable into positions for holding the flap of the envelope in the inserting position, wherein the flap opener is movable for pivoting the flap relative to the envelope body about the flap fold to an open position while the flap is held against the flap opener.

Such an apparatus is specifically adapted for carrying out a method according to the invention.

Because the flap of the envelope in the inserting position is held against the flap opener of which a free edge has abutted the fold of that envelope, the position of the envelope is accurately controlled in a very simple manner. Moreover, because the position of the fold between the envelope body and the flap is directly controlled, no specific measures are required for positioning envelopes of different heights in the inserting position.

Particular elaborations and embodiments of the invention are set forth in the dependent claims.

Further features, effects and details of the invention appear from the detailed description and the drawings.

DETAILED DESCRIPTION

Figure 1:
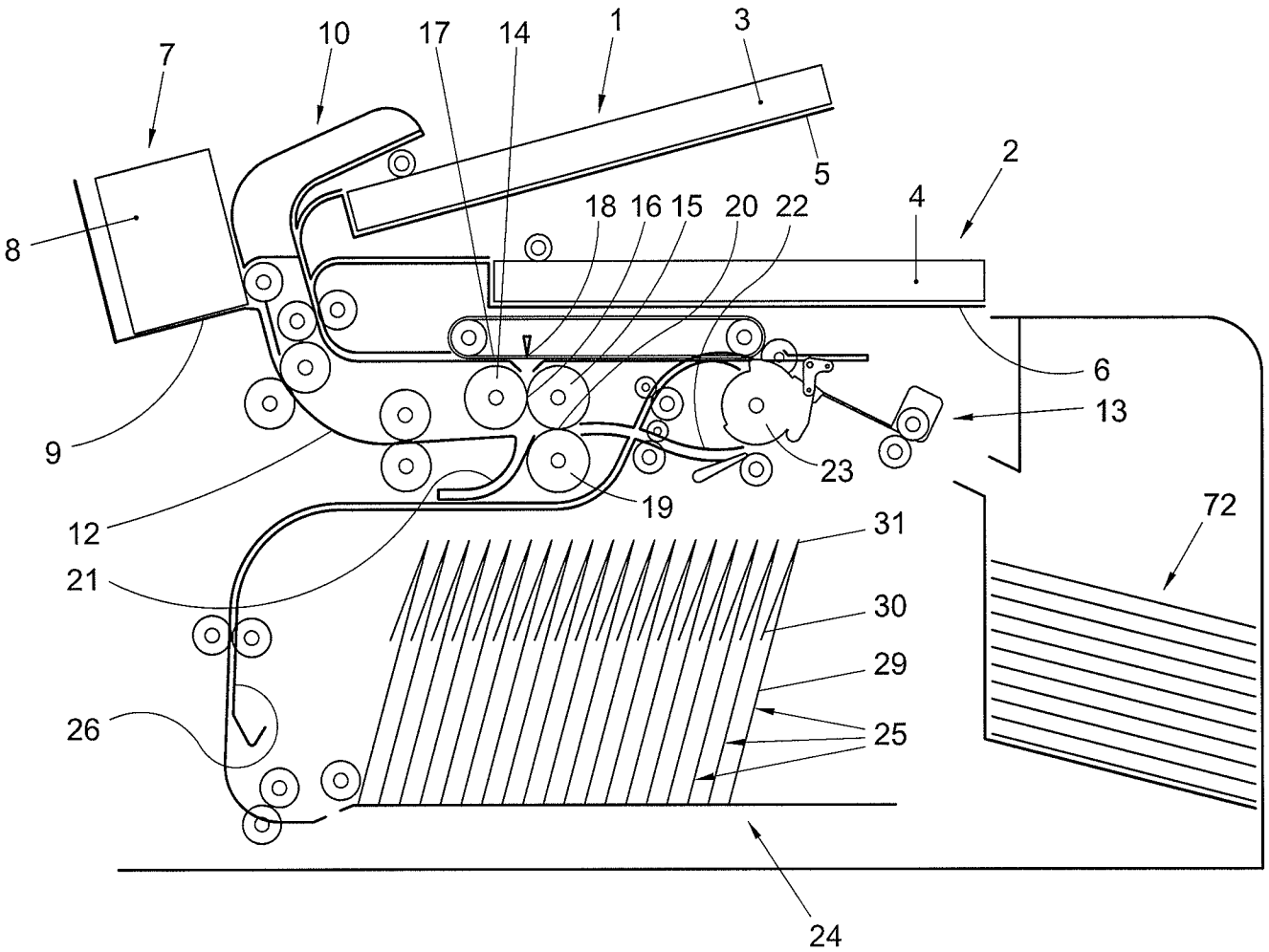
FIG. 1 is a schematic cut-away side view of an example of an apparatus according to the invention.

In FIG. 1, an overview of an example of an inserter apparatus according to the invention is shown. The inserter has sheet feeders 1, 2, for separating and feeding postal items in the form of sheets one by one from stacks 3, 4 in trays 5, 6, a card feeder 7 for separating and feeding postal items in the form of cards from a stack 8 in a hopper 9 and a manual feeder 10 for receiving and feeding individual postal items that are inputted manually, for the individual processing of individual postal items such as letters that have been printed individually and signed personally. A first postal item transport path 11 leads away from the sheet feeders 1, 2 and from the manual feeder 10 and a second postal item transport path 12 is provided for transporting postal items away from the card feeder 7.

The first postal item transport path 11 leads to a pair of folding rollers 14, 15 defining a first folding nip 16 between first and second folding rollers 14, 15 for folding the sheets, a transport belt 17 and a folding knife 18 being arranged upstream of the first folding nip 16 for controlling the folding of the postal items, which may each consist of one or more sheets. Such a folding apparatus is disclosed in more detail in European patent application appl. no. 08152509.

A third folding roller 19 is arranged for defining a second folding nip 20 between the second folding roller 15 and the third folding roller 19. A buckle chute 21 is aligned with the first folding nip 16 for receiving a leading end of a postal item (which may be folded or not) and oriented such that the postal item is then buckled into the second folding nip 20. A postal item transport path 22 extends from the second folding nip 20 towards the inserting position 13 and passes closely along a flap support roller 23.

The inserter is further equipped with a feeder 24 including a hopper for holding stacked envelopes 25 (not all the envelopes are designated by reference numerals) and separating and feeding individual envelopes 25 from the stacked envelopes to an envelope transport path 26. Such a feeder is disclosed in more detail in European patent application appl. no. 07002072.

The envelope transport path 26 extends to a side of the flap support roller 23 which about diametrically opposite the side of the flap support roller 23 where the postal item transport path 22 passes along the flap support roller 23.

The envelopes 25 to be processed each have an envelope body 29 and a flap 30 hinged to the envelope body 29 along a flap fold 31 (see one of the envelopes 25 in FIG. 1). The envelope transport path 26 is bounded by guides and arranged for transporting an envelope 25 with its envelope body 29 in an orientation parallel to the envelope transport path 26 and with the flap fold 30 trailing the envelope body 29 and the flap 30 (see FIG. 2).

The inserter is further equipped with a flap opener 38 having a free flap opener edge 39 and an envelope body guide 40. In a starting position, shown in FIG. 2, the free edge 39 of the flap opener 38 is positioned off-set relative to a continuation of the envelope transport path 26 beyond a downstream end of the envelope transport path 26, such that a leading edge 36 of the envelope 25 travelling in a direction indicated by an arrow 37 passes along a side of the free edge 39 located away from the flap support roller 23. In this example, the downstream end of the envelope transport path 26 is constituted by flap closing roller nips 48 between a flap closing roller 49 and counter rollers 69 of which the outer circumference projects slightly outside the circumference of the flap support roller 23.

Figure 5:
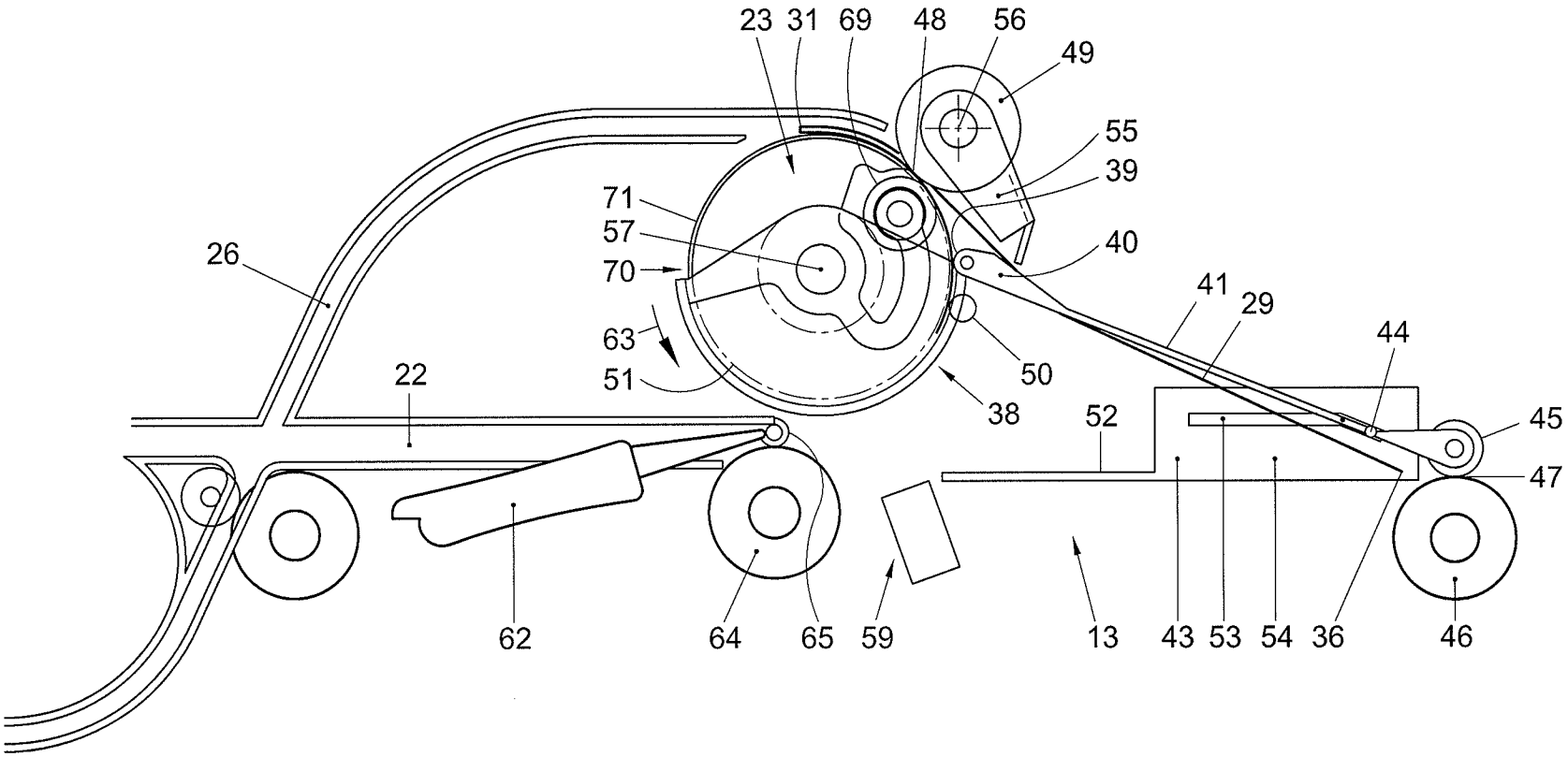

The envelope body guide 40 is integrally formed with control arms 41 of which a free end carries envelope transport rollers 45. Envelope discharge rollers 46 located adjacent an envelope support platform 52 contact the envelope transport rollers 45 carried by the control arms 41 for forming transport nips 47, at least when the control arms 41 are in a discharge position for discharging the envelope 25 (FIG. 5). The envelope body guide control arms 41 have notches 44 that are guided by guide tracks 53 in guide plates 54 on opposite lateral sides of the envelope support platform 52 and approximately parallel to the envelope support platform 52.

The flap opener 38 is held in the starting position by a flap opener displacement control arm 55 that is pivotable about an axis of rotation 56 coaxial with the flap closing roller 49. A spring force exerted by a spring (not shown) which exerts a moment urging the flap opener 38 in an anti-clockwise sense of rotation (upstream against the sense of transport 37).

Figure 6:
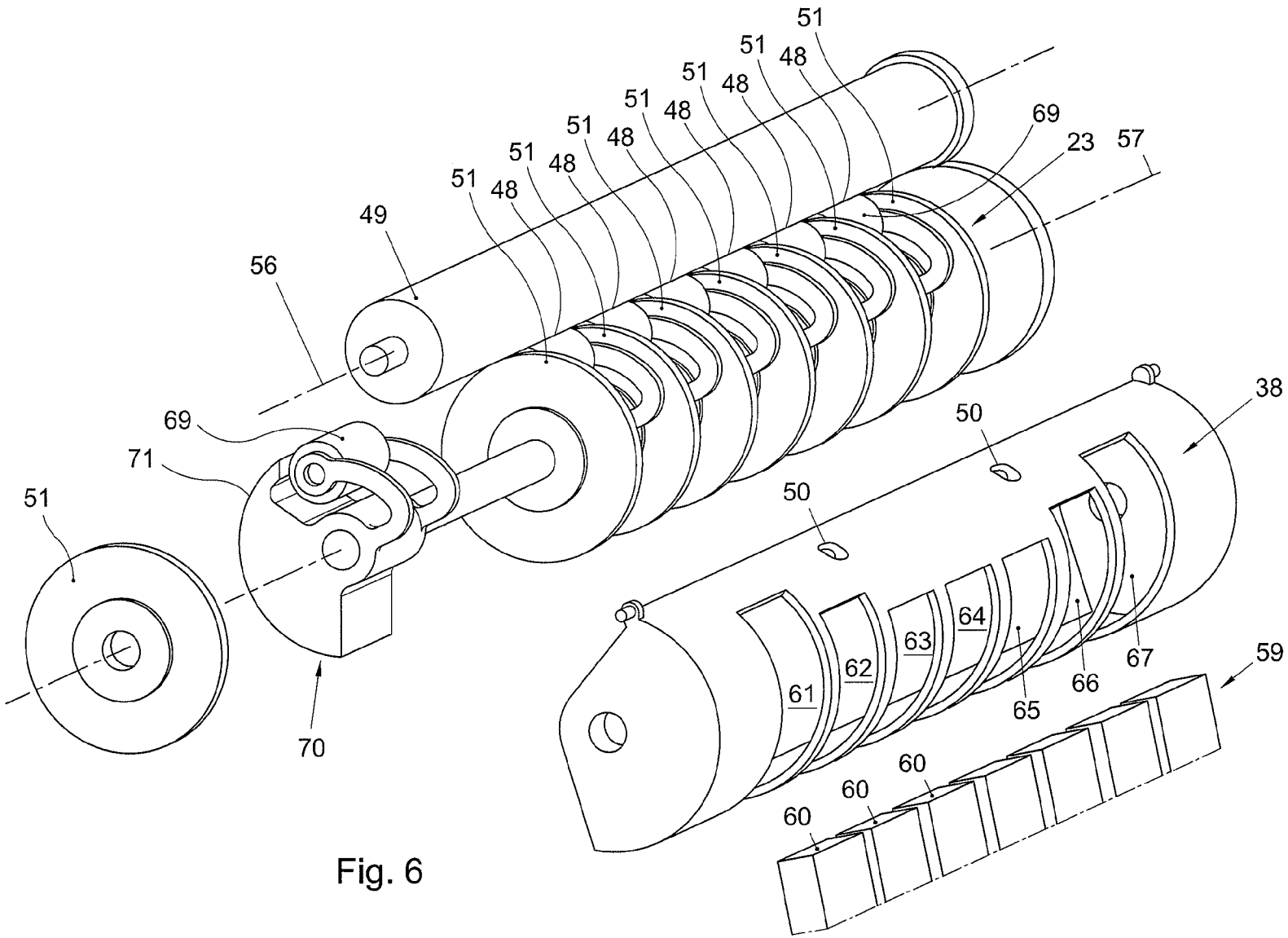
FIG. 6 is an exploded view of some parts shown in FIGS. 2-5.

The flap opener 38 is equipped with rollers 50 rotatably suspended and positioned for holding a flap between the rollers 50 and the flap support roller 23. The flap support roller 23 thus constitutes a member for holding the flap against the flap opener 30. As is best seen in FIG. 6, the flap support roller 23 is constituted by a plurality of disks 51 that are mutually spaced in axial direction and distributed over the width of the flap support roller 23. The rollers 50 of the flap opener 38 are each positioned opposite of one of the disks 51 for forming a flap engagement nip.

In axial direction, the counter rollers 69 are each positioned between two of the disks 51 of the flap support roller 23. The counter rollers 69 are each carried by a counter roller carrier 70, which is rotatably mounted about the axis 57 of the flap support roller 23 and each have a cylinder segment surface 71 having a radius of which the axis 57 of the flap support roller 23 constitutes the center.

Figure 2:
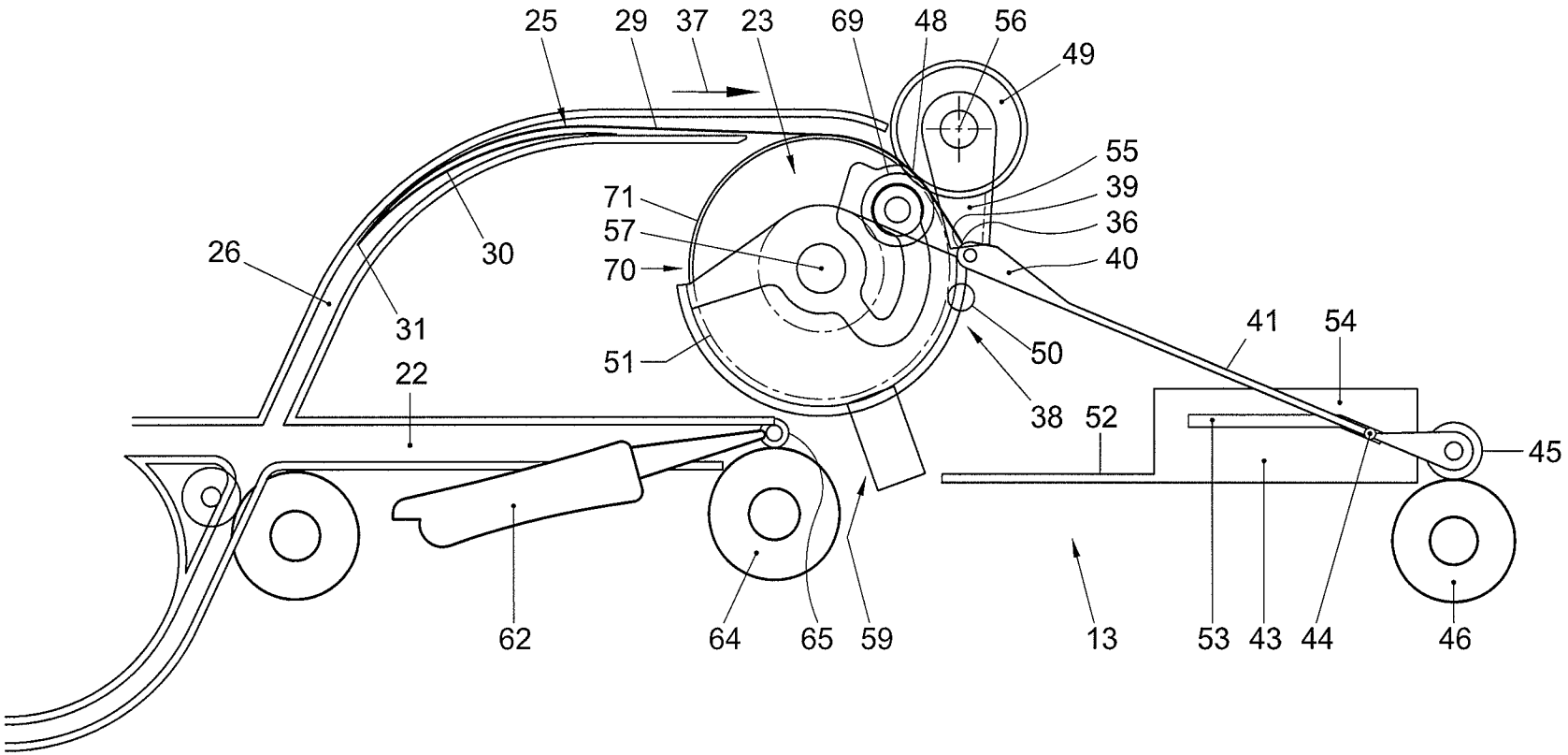
FIGS. 2-5 are schematic side views of a portion of the apparatus according to FIG. 1 in four successive operating stages.
Figure 3:
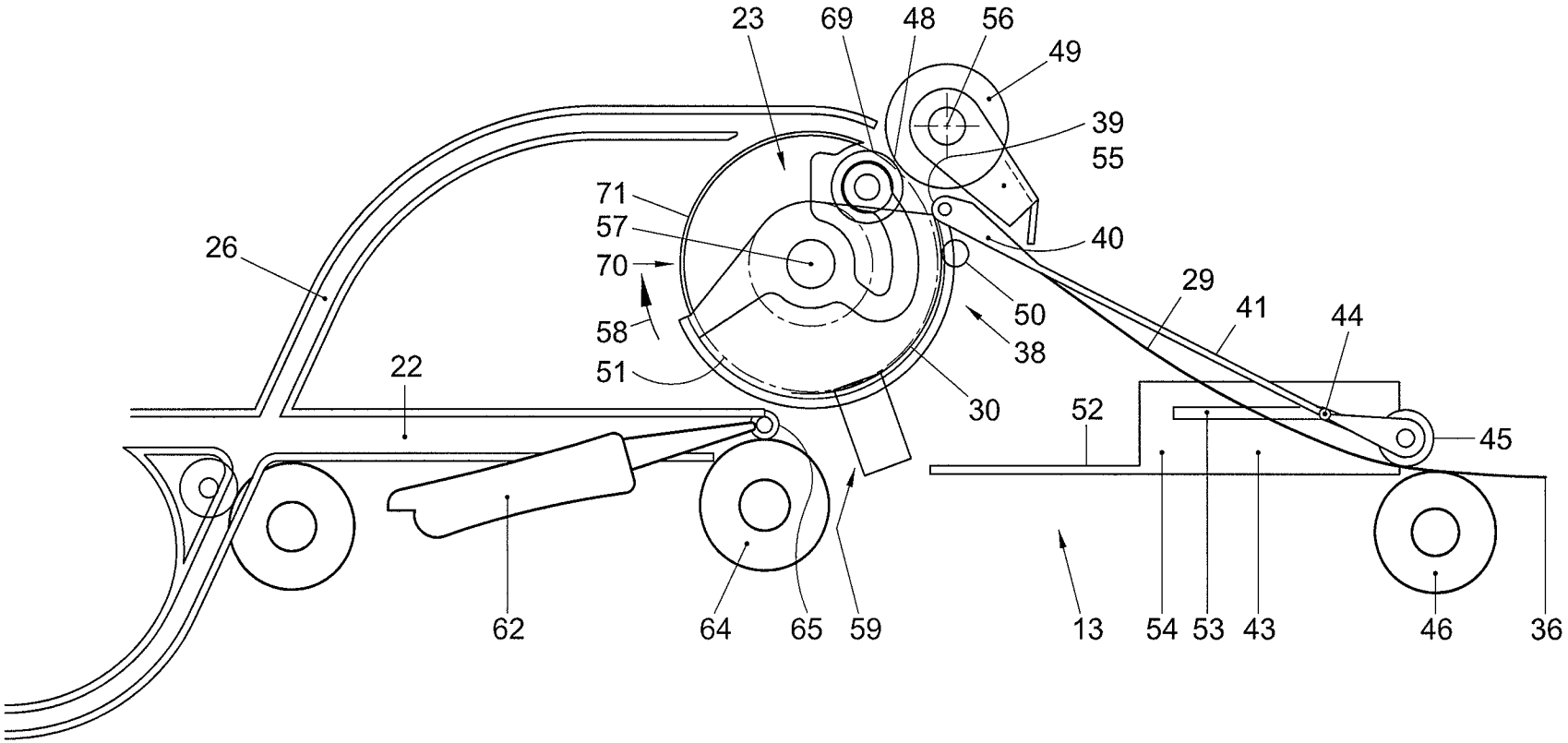

In FIG. 3, the free flap opener edge 39 is in a position off-set to a side of a continuation of the envelope transport path 26 opposite to the side to which the free flap opener edge 39 is off-set in the position shown in FIG. 2, for causing the flap 30 to be peeled away from the envelope body 29 and to enter between the flap opener 38 and the flap support roller 23, as the leading free end of the flap 30 reaches the free edge 39 of the flap opener 38 and the flap 30 continues to move along with the circumference of the flap support roller 23. Thus, the free edge 39 is entered between the flap 30 and the envelope body 29 until the flap fold 31 abuts the free flap opener edge 39. The displacement of the free flap opener edge 39 from the starting position shown in FIG. 2 to the flap peeling position shown in FIG. 3 is driven by the spring force urging the flap opener 38 in an anti-clockwise sense of rotation in response to the flap opener displacement control arm 55 being displaced away from the flap support roller 23 and the flap opener 38 by the leading edge 36 of the envelope 25 after the envelope has reached the position shown in FIG. 2. The counter rollers 69 rotate along with the rotation of the flap opener 38 about the axis 57 of the flap support roller 23 in the anti-clockwise sense of rotation, but stay in contact with the flap closing roller 49. With the counter rollers 69 in the operating position shown in FIG. 3, the flap closing roller nips 48 between the counter rollers 69 and the flap closing roller 49 are displaced about the circumference of the envelope closing roller 49 relative to the operating position shown in FIG. 2, in the same sense of rotation as the sense of rotation 58 of the flap support roller 23 during the passage of the envelope 25 towards the inserting position 13. This causes the leading end of the flap 30 to be fed out of the flap closing roller nips 48 between the counter rollers 69 and the flap closing roller 49 in a direction more closely along the flap support roller 23 than the direction in which the leading end of the envelope body 29 was fed out of the flap closing roller nips 48 with the counter rollers 69 in the operating position shown in FIG. 2.

By feeding out the envelope body 29 in a first direction and then feeding out the envelope flap 30 in a second direction different from the first direction, the first and the second directions pointing to different sides of the free flap opener edge 39, the flap 30 is more reliably caught on a side of the free flap opener edge 39 opposite of the side to which the envelope body 29 is guided, so as to be able to reliably bend the flap 30 open.

The inserter is further equipped with an envelope flap moistener 59. The flap moistener 59 is movable between a moistening position in which moistening members 60 of sponge material project towards the circumferential surface of the flap support roller 23 through slots 61-67 (FIG. 6) in the flap opener 38 and a retracted position in which the flap moistener is displaced radially away from the flap support roller 23 and the flap opener 38. The moistener is shown in its moistening position in FIGS. 2 and 3 and in its retracted position in FIGS. 4-6. Surfaces of the moistening members 60 facing the flap support roller 23 are axially located such that the surfaces are not located opposite the circumferential surfaces of the disks 51 of the flap support roller 23. Moistening of the circumferential surfaces of the disks 51 of the flap support roller 23 is thus avoided.

After the envelope flap 30 has entered between the flap support roller and the flap opener 38, the flap 30 contacts the moistener 59 as its leading end reaches the moistener. The flap 30 is then moved along the moistener 59 as it is further inserted between between the flap support roller and the flap opener 38, so that the gum is moistened. Since the gum is moistened only in the areas of the flap 30 that are axially in line with the slots 61-67 in the flap opener 38, gum that has been moistened does not contact the flap opener 38 in spite of the flap 30 being moistened prior to insertion of postal items into the envelope 25. That the envelope flap 30 is moistened prior to insertion of postal items into the envelope 25 is advantageous, because more time is left between moistening and closing of the envelope 25, thereby allowing the moisture to be absorbed more deeply and evenly by the gum before the envelope is closed. This results in an improved adhesion of the flap 30 to the envelope body 29 and less penetration of humidity into the paper of the envelope body and the contents of the envelope 25.

The flap opener 38 is movable for pivoting the flap 30 held against the flap opener 38 relative to the envelope body 29 about the fold 31 to an open position. In the present example, this is realized in the form of pivotability of the flap opener 38 about an axis of rotation 57 of the flap support roller 23. After the fold 31 between the flap 30 and the envelope body has passed the flap closing roller nips 48 between the flap closing roller 49 and the counter rollers 69, the flap 30 of the envelope 25 is entrained further by the rotation of the flap support roller 23 in the sense of rotation indicated by arrow 58, since the flap 30 is held against the flap support roller 23 by the rollers 50 of the flap opener 38. When the fold 31 between the flap 30 and the envelope body 29 abuts against the free edge 39 of the flap opener 38, the flap opener 38 is entrained by the envelope 25, of which the flap 30 moves along with the circumferential surfaces of the flap support roller 23, until a position shown in FIG. 4 has been reached in which the free edge 39 of the flap opener 38, and accordingly the fold 31 between the flap 30 and the envelope body 29 is in an accurately controlled position.

The flap opener 38 is coupled to the counter roller carriers 70 for co-rotation with the counter roller carriers 70, so that the rotation of the flap opener 38 also causes the counter roller carriers 70 to rotate in the sense of rotation 58. As the flap opener 38 is rotated, briefly after the counter rollers 69 have become free from the envelope closing roller 49, the cylinder segment surfaces 71 of the counter roller carriers 70 contact the driven flap closing roller 49. The position in which the free flap opener edge 39 is stopped is then controlled by stopping the flap closing roller 49 so that the free flap opener edge 39 reaches the position shown in FIG. 4 in which the envelope 25 is in the insert position with the envelope throat downstream of the postal item transport path 22.

In the present example, this is achieved by providing that when the flap opener 38 reaches the position in which its free edge 39 is positioned for holding the envelope 25 in the insert position, the flap opener 38 contacts an operating member of a wrap spring coupling (not shown) that causes the flap pressing roller 49 to be uncoupled from a drive (not shown).

Figure 4:
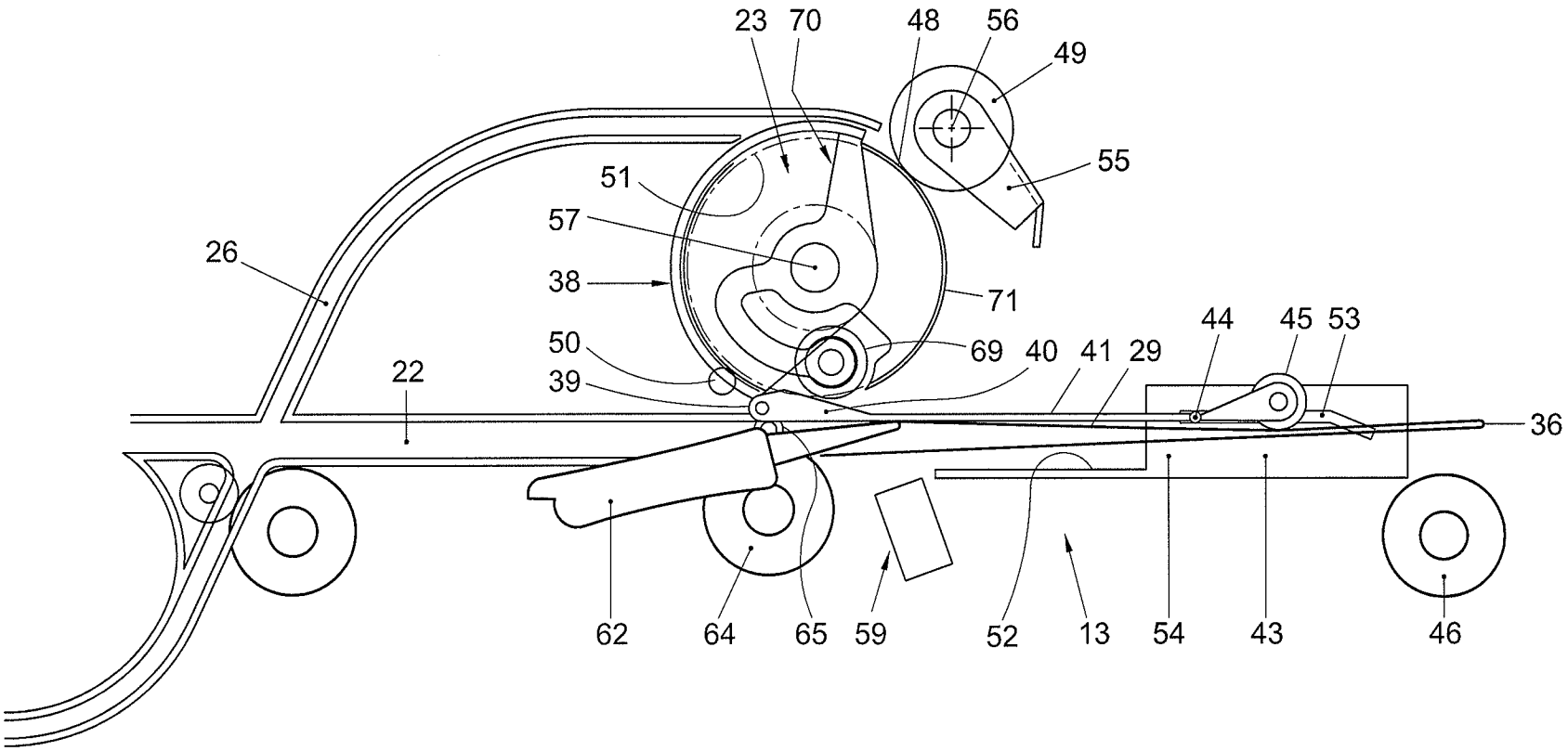

While the flap opener 38 rotates from the flap scraping position shown in FIG. 3 to the insert receiving position shown in FIG. 4, the flap moistener 59 may initially be in its flap moistening position to further moisten the flap 30 of the envelope 25. Depending on the shape and size of the gummed area of the flap 30 and at least before the free edge 39 of the flap opener 38 reaches the flap moistener 59, the flap moistener 59 is retracted to its retracted position so that only or mainly the gummed area of the flap 30 of the envelope 25 is moistened.

In the present example, the flap moistener surfaces 60 are arranged in a row extending along a straight line parallel to the axis 57 of the flap support roller 23. It is however also possible to provide that the flap moistener surfaces 60 are arranged in a configuration having sections that extend at angles relative to each other.

After the envelope 25 has reached the inserting position shown in FIG. 4, a throat opener 62 is moved from a retracted position shown in FIGS. 2, 3 and 5 to an inserted position shown in FIG. 4, a free end of the throat opener 62 initially being guided by an upper guide of the postal item transport path 22, then by the envelope body guide 40 and finally by an inner surface of the envelope flap 30 and the envelope body 29. The throat opener 62 in the inserted position holds the throat (the open end) of the envelope 25 open allowing the postal items to be passed into the envelope body 29 smoothly and reliably. During the rotation of the flap opener 38 about the axis 57 of the flap support roller 23, the envelope body guide control arms 41 have been entrained with the flap opener 38, causing the envelope transport rollers 45 to be moved to a position spaced from the envelope discharge rollers 46, leaving room for the envelope body 29 to accommodate to postal items inserted therein.

Next, the separated ones of the postal items 3, 4, 8 fed along the postal item transport path 22 are displaced along the envelope throat opener and into the envelope 25 by insert rollers 64, 65.

After the postal items have been inserted into the envelope 25, the throat opener 62 is retracted to its retracted position and the flap pressing roller 49 is driven in a sense opposite to its sense of rotation during feeding of the envelope 25, causing the counter roller carriers 70 and accordingly also the flap opener 38 and the flap support roller 23, to be entrained in a sense indicated by arrow 63 in FIG. 5, which is opposite to the sense of rotation 58 indicated in FIG. 3. This causes the counter roller carriers 70 and accordingly also the flap opener 38 and the flap support roller 23 to return to the flap opening position shown in FIG. 3 in which position it abuts against the flap opener displacement control arm 55. The flap opener displacement control arm 55 has been left in a position slightly away from the flap support roller 23 to avoid that it interferes with the envelope body 29.

The rotation of the flap support roller 23 causes the flap 30 engaged between disks of the flap support roller 23 and the rollers 50 of the flap opener 38 to be urged back into the flap closing roller nips 48 between the flap closing roller 49 and the counter rollers 69, which flap closing roller nips 48 have meanwhile been re-established since the counter roller carriers 70 have returned to the flap opening position. As the envelope 25 is engaged in the flap closing roller nips 48, the envelope 25 is transported in a discharge sense opposite to the feeding sense along the envelope transport path 26, the flap 30 is closed and pressed against the envelope body 29 between the flap closing roller 49 and the counter rollers 69.

After the entire flap 30 has passed through the flap closing roller nip 48 between the flap closing roller 49 and the counter rollers 48, the sense of rotation of the flap closing rollers 49 is again reversed and the envelope discharge roller 46 is driven to transport the filled and closed envelope 25 through the transport nip 47 into an output holder 72.

Finally, the flap opener displacement control arm 55 is pivoted back to the starting position shown in FIG. 2 so that the envelope body guide 40 is again repositioned for guiding an envelope body of a next envelope along a top side of the envelope body guide 40.

Many other variations to the disclosed embodiments can be understood and effected by those skilled in the art in practicing the claimed invention, from a study of the drawings, the disclosure, and the appended claims. For instance, instead of a flap opener pivotable about an axis coaxial with the axis of rotation of a flap support roller, the flap opener may also be arranged to be pivotable about another axis while the flap is clamped against the flap opener or held against the flap opener by suction. Moreover, additionally or as an alternative, the flap may also be opened further by pivoting the envelope body into the inserting position.

Furthermore, the envelopes may be arrive at the inserting position along the same transport path as the documents, the flap being caught by the flap opener and held out of the common transport path, each time an envelope is in the inserting position, allowing the postal items to pass along the flap and into the envelope body.

The invention claimed is:

1. A method for inserting a postal item into an envelope having an envelope body and a flap hinged to the envelope body along a flap fold, comprising the steps of:

feeding the envelope with the flap fold trailing the envelope body and the flap along a flap opener;

entering a moveable free flap opener edge of a flap opener between the flap and the envelope body;

holding the flap against the flap opener; and while holding the flap against the flap opener, pivoting the flap relative to the envelope body about the flap fold to an open position, wherein the step of entering a free flap opener edge between the flap and the envelope body is carried out until the flap fold abuts the free flap opener edge, and the method further comprises the steps of:

while holding the flap against the flap opener moving the flap opener and the envelope to an insert position, said free flap opener edge being positioned for holding the envelope in the insert position, and inserting the postal item into the envelope body while holding the flap against the flap opener.

2. A method according to claim 1, wherein, during feeding of the envelope:

the free flap opener edge is in a first position while a leading edge of the envelope passes the free flap opener edge on a first side;

subsequently, the free flap opener edge is moved to a second position; and subsequently, the flap is guided along a second side of the free flap opener edge opposite the first side of the free flap opener edge, causing the free flap opener edge to enter between the flap and the envelope body.

3. A method according to claim 1, wherein, after the insertion of the postal item, the envelope is initially displaced away from the inserting position with the free flap opener edge in abutment with the flap fold.

4. A method according to claim 1, wherein, after the insertion of the postal item, the flap is initially partially closed while the free flap opener edge is in abutment with the flap fold.

5. A method according to claim 4, wherein the closing of the flap is completed by passing the envelope through a flap closing roller nip with the flap fold leading.

6. A method according to claim 1, wherein the flap is moistened while the flap is held against the flap opener.

* * * * *